US012523136B2

(12) United States Patent
Snyder et al.

(10) Patent No.: US 12,523,136 B2
(45) Date of Patent: Jan. 13, 2026

(54) SAND COLLECTOR FOR SUCKER ROD PUMP

(71) Applicant: Daniel J. Snyder, Edmond, OK (US)

(72) Inventors: Daniel J. Snyder, Edmond, OK (US); Jeremy J. Snyder, Livermore, CA (US)

(73) Assignee: Daniel J. Snyder, Edmond, OK (US)

( * ) Notice: Subject to any disclaimer, the term of this patent is extended or adjusted under 35 U.S.C. 154(b) by 0 days.

(21) Appl. No.: 18/886,507

(22) Filed: Sep. 16, 2024

(65) Prior Publication Data

US 2025/0084747 A1 Mar. 13, 2025

Related U.S. Application Data

(63) Continuation of application No. 18/392,111, filed on Dec. 21, 2023, now Pat. No. 12,091,956, which is a continuation of application No. 17/818,937, filed on Aug. 10, 2022, now Pat. No. 11,852,003.

(60) Provisional application No. 63/231,315, filed on Aug. 10, 2021.

(51) Int. Cl.
*E21B 43/34* (2006.01)
*E21B 43/12* (2006.01)

(52) U.S. Cl.
CPC ..... *E21B 43/35* (2020.05); *E21B 43/127* (2013.01)

(58) Field of Classification Search
CPC ..... E21B 43/127; E21B 43/35
See application file for complete search history.

(56) References Cited

U.S. PATENT DOCUMENTS

| | | | |
|---|---|---|---|
| 642,483 | A | 1/1900 | Pew |
| 2,311,963 | A | 2/1943 | Pyle |
| 2,815,190 | A | 12/1957 | Dawson, Jr. |
| 3,090,324 | A | 5/1963 | Schmidt |
| 5,553,669 | A | 9/1996 | Trainer |
| 6,152,218 | A | 11/2000 | Safargar |
| 6,216,788 | B1 | 4/2001 | Wilson |

(Continued)

FOREIGN PATENT DOCUMENTS

| | | |
|---|---|---|
| CN | 105134586 B | 8/2017 |
| CN | 206458588 U | 9/2017 |

OTHER PUBLICATIONS

International Search Report and Written Opinion dated Nov. 29, 2022; (12 pgs).

*Primary Examiner* — Shane Bomar
(74) *Attorney, Agent, or Firm* — Dunlap Codding, P.C.

(57) ABSTRACT

A sand collector including a diverter section and a filter section. The diverter section has a tubular portion with at least one aperture extending therethrough and at least one collector extending outwardly therefrom to cooperate with an exterior side of the tubular portion to form a channel in which solids traveling on the exterior side of the tubular portion from the upper end toward the lower end are guided to the aperture. The filter section having a tubular portion with an upper end, a lower end, and a sidewall extending between the upper end and the lower end. The filter section having at least one aperture extending through the sidewall, the upper end of the filter section extending from the lower end of the collector section and the lower end of the filter section being closed and connectable to at least one of another sucker rod and an upper end of a pump assembly.

11 Claims, 12 Drawing Sheets

(56) References Cited

U.S. PATENT DOCUMENTS

| | | | |
|---|---|---|---|
| 7,008,197 | B2 | 3/2006 | Ford |
| 7,404,702 | B2 | 7/2008 | Ford |
| 9,163,483 | B2 | 10/2015 | Ford |
| 9,181,785 | B2 | 11/2015 | Lawson et al. |
| 9,441,435 | B2 | 9/2016 | Leitch |
| 10,082,014 | B2 | 9/2018 | Fielder, III et al. |
| 10,184,328 | B1 | 1/2019 | Holleman |
| 10,458,211 | B2 | 10/2019 | Ford |
| 10,605,064 | B1 | 3/2020 | Raglin |
| 10,605,065 | B1 | 3/2020 | Raglin et al. |
| 10,731,446 | B2 | 8/2020 | Stachowiak et al. |
| 10,760,398 | B2 | 9/2020 | Webber et al. |
| 10,947,813 | B2 | 3/2021 | Ejim et al. |
| 11,149,524 | B2 | 10/2021 | Reed et al. |
| 11,300,121 | B2 | 4/2022 | Correa et al. |
| 11,371,332 | B2 | 6/2022 | Xiao et al. |
| 2002/0134554 | A1 | 9/2002 | Schrenkel et al. |
| 2006/0083646 | A1 | 4/2006 | Ford |
| 2008/0210417 | A1 | 9/2008 | Ford |
| 2008/0314581 | A1 | 12/2008 | Brown |
| 2010/0108150 | A1 | 5/2010 | Ford |
| 2011/0024119 | A1 | 2/2011 | Wolf et al. |
| 2013/0140032 | A1 | 6/2013 | Ford |
| 2013/0140247 | A1 | 6/2013 | Ford |
| 2016/0177696 | A1 | 6/2016 | Raglin |
| 2016/0237796 | A1 | 8/2016 | Stachowiak et al. |
| 2016/0251951 | A1 | 9/2016 | Stachowiak et al. |
| 2017/0328190 | A1 | 11/2017 | Fielder, III et al. |
| 2018/0266232 | A1 | 9/2018 | Leitch |
| 2018/0283155 | A1* | 10/2018 | Saponja ..... E21B 43/121 |
| 2018/0298736 | A1 | 10/2018 | Bailey et al. |
| 2020/0011327 | A1 | 1/2020 | Stachowiak, Jr. |
| 2020/0263688 | A1 | 8/2020 | Correa et al. |
| 2021/0164310 | A1 | 6/2021 | Head et al. |
| 2022/0049575 | A1 | 2/2022 | Coon et al. |
| 2022/0331714 | A1 | 10/2022 | Coon et al. |
| 2025/0059872 | A1* | 2/2025 | Snyder ..... E21B 43/127 |
| 2025/0101846 | A1* | 3/2025 | Steele ..... E21B 43/38 |

* cited by examiner

SAND COLLECTOR FOR SUCKER ROD PUMP

CROSS-REFERENCE TO RELATED APPLICATIONS

This application is a continuation of U.S. Ser. No. 18/392,111, filed on Dec. 21, 2023, now U.S. Pat. No. 12,091,956, which is a continuation of U.S. Ser. No. 17/818,937, filed on Aug. 10, 2022, now U.S. Pat. No. 11,852,003, which claims priority to U.S. Provisional Application No. 63/231,315, filed Aug. 10, 2021, each of which is hereby incorporated herein by reference in their entirety.

BACKGROUND

Sucker rod pumps are often used when the natural pressure of an oil and gas formation is insufficient to lift the oil to the surface of the earth. Sucker rod pumps operate by admitting fluid from the formation into a tubing and then lifting the fluid to the surface. To accomplish this, the sucker rod pump contains, among others, four elements: a pump or working barrel, a plunger that travels in an up and down motion inside the pump barrel, a standing valve positioned near the lower end of the pump barrel, and a traveling valve that is attached to and travels with the plunger. A chamber is formed inside the pump barrel between the standing valve and the traveling valve. The standing valve allows fluid to flow into the chamber but does not allow fluid to flow out of the chamber. The traveling valve allows fluid to flow out of the chamber, but not into the chamber.

When the fluid that the sucker rod pump is pumping is substantially all liquids, the plunger is mechanically made to move up and down in a reciprocating motion. On the upstroke of a pumping cycle, where the plunger is moved upward, the hydrostatic pressure of the fluid above the traveling valve causes the traveling valve to close. The upward motion of the plunger also causes a negative fluid pressure to develop inside the chamber causing the standing valve to open and to admit fluid from the formation into the chamber.

At the end of the upstroke, the chamber is filled with liquid from the formation. When the plunger begins the downstroke, the pressure in the chamber becomes positive which causes the standing valve to close. Because liquids are substantially incompressible, the pressure in the chamber rapidly increases to a pressure greater than the fluid column pressure above the traveling valve. When the fluid pressure in the chamber becomes greater than the fluid column pressure above the traveling valve, the traveling valve opens and fluid passes by the traveling valve where it can be lifted by the sucker rod pump on the upstroke.

With many production systems that use a downhole pump, problems can arise when the pump is shut down after a period of pumping fluid up the production tubing to surface. On pump shutdown, flow ceases quickly as the fluid levels in the production bore and the annulus equalize. Gravity acting on the sand particles present in the column of fluid above the pump (which could be several thousand feet) causes the sand and any other solids to fall back towards the pump. Due to the complex configuration of the interior features of the pump, there is no direct path for the sand to pass through the pump, and therefore it settles on top of the pump. This can cause damage to the premature wear to the pump and even cause the pump to seize. Such failure of the downhole pump requires work-over involving pull-out and reinstallation of the completion. This is an expensive and time-consuming operation.

To this end, a need exists for an improved sand collector for use with reciprocating rod pumps for preventing or reducing the number of solids from reentering into the pump. It is to such an improved sand collector that the inventive concepts disclosed herein are directed.

DETAILED DESCRIPTION OF EXEMPLARY EMBODIMENTS

Figure 1:
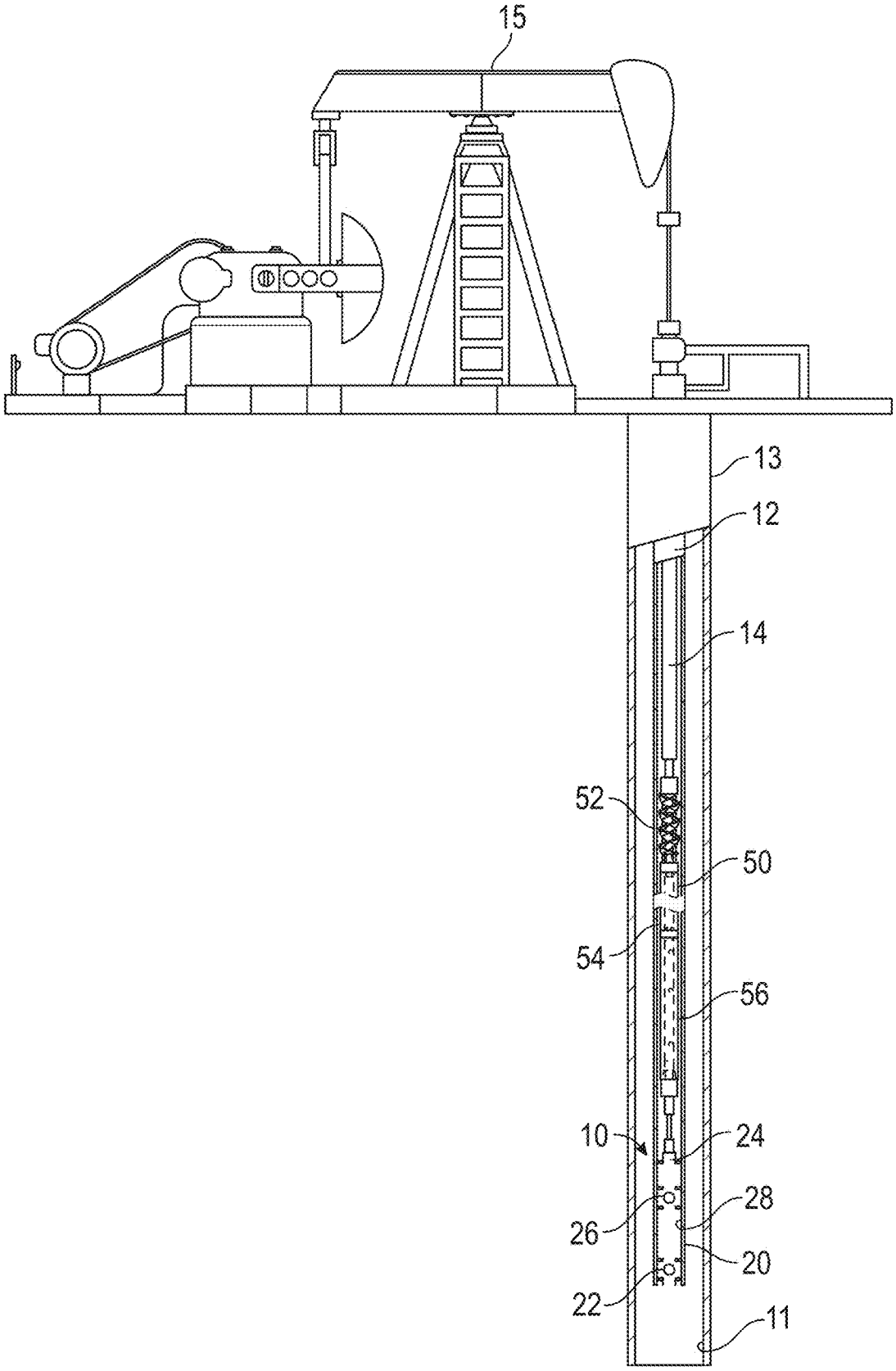
FIG. 1 is a schematic view of a sucker rod pump assembly with a downhole sand collector constructed in accordance with the inventive concepts disclosed herein incorporated with the sucker rod pump assembly.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and more particularly to FIG. 1, a sucker rod pump or downhole pump assembly 10 is shown in a wellbore 11 of a well. The wellbore 11 may be provided with a casing 13 that may be perforated at one or more positions along its length. The perforations allow fluids from the surrounding formation to enter the casing 13. The fluids may include liquids and gases.

The downhole pump assembly 10 is secured within a tubing string 12 and used with a pump jack unit 15 and a sucker rod string 14 including a plurality of sucker rods for elevating fluids, such as hydrocarbons, to the earth's surface. The downhole pump assembly 10 includes a pump barrel 20, a standing valve 22, a plunger 24, and a traveling valve 26. The pump barrel 24 supports the standing valve 22 in a lower end thereof. The standing valve 22 is illustrated as a conventional ball check valve.

The plunger 24 is disposed in the pump barrel 20 and is adapted for reciprocating movement through pump barrel 20. The traveling valve 26 is in a lower end of the plunger 24 to permit one way flow of fluid into the plunger 24. The traveling valve 26 is shown to be a ball check valve and a seat.

On the upstroke of a pumping cycle, the plunger 24 is moved in an upward direction. The hydrostatic pressure of the fluid above the traveling valve 26 causes the traveling valve 26 to close. The upward motion of the plunger 24 further causes a negative pressure to develop inside a chamber 28 below the plunger 24 causing the standing valve 22 to open and admit fluid from the formation into the chamber 28.

At the end of the upstroke, the portion of the chamber 28, the traveling valve 26, and the standing valve 22 are filled with liquid from the formation. When the plunger 24 begins the downstroke, the pressure in the chamber 28 becomes positive which causes the standing valve 22 to close. Because liquids are substantially incompressible, the pressure in the chamber 28 rapidly increases to a pressure greater than the pressure above the traveling valve 26. When the fluid pressure in the chamber 28 becomes greater than the pressure above the traveling valve 26, the traveling valve 26 opens and fluid passes through the traveling valve 26 where it can be lifted by the plunger 24 on the subsequent upstroke.

As further stated above, problems can arise when the pump assembly 10 is shut down after a period of pumping fluid up the production tubing to the surface. On pump assembly 10 shutdown, flow ceases as the fluid levels in the production bore and the annulus equalize. Gravity acting on the sand particles present in the column of fluid above the pump causes the sand and any other solids to fall back toward the pump assembly 10. Due to the complex configuration of the interior features of the pump assembly 10, there is no direct path for the sand to pass through the pump assembly 10, and therefore it settles on top of the pump assembly 10. This can cause damage to the premature wear to the pump assembly 10 and even cause the pump assembly 10 to seize.

A sand collector 50 constructed in accordance with inventive concepts disclosed herein is shown incorporated into the sucker rod string 14 so the sand collector 50 is positioned above the plunger 24 to collect sand and other solids falling toward the pump assembly 10 and thereby reduce the amount of sand and solids entering the pump assembly 10 when the pump assembly 10 is shut down.

Referring now to FIGS. 2-7, non-limiting in one embodiment, the sand collector 50 includes a diverter section 52, a collection section 54, and a filter section 56.

Figure 3:
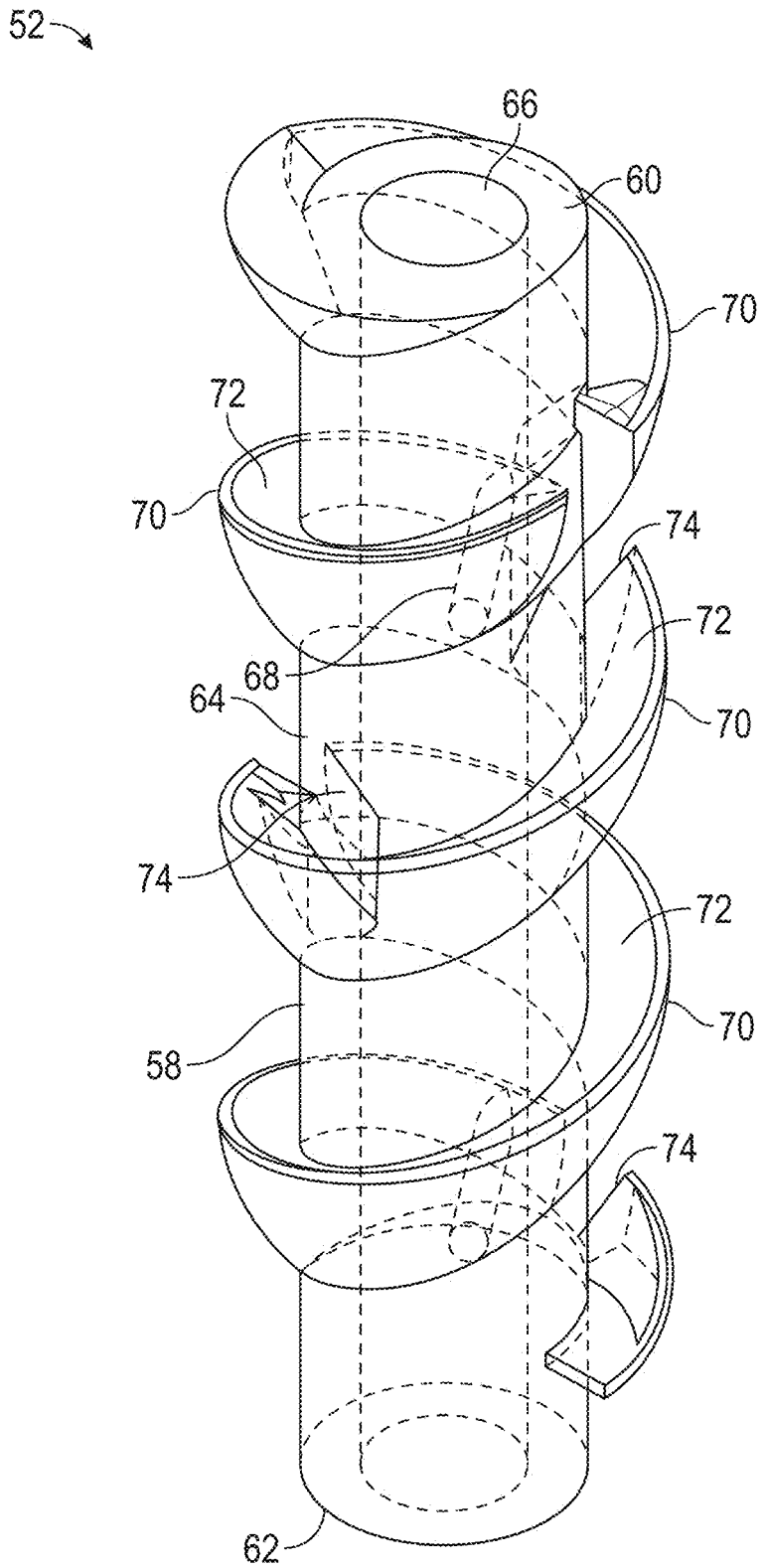
FIG. 3 is a cross-sectional view of a diverter section of the sand collector.

Referring to FIG. 3, the diverter section 52 includes a tubular portion 58 with an upper end 60, a lower end 62, and a sidewall 64 defining a chamber 66 extending between the upper end 60 and the lower end 62 and having at least one aperture 68 extending therethrough in fluid communication with the chamber 66. The diverter section 52 further includes at least one collector 70 extending outwardly from the sidewall 64 to cooperate with an exterior side of the tubular portion 58 to form a channel 72 in which solids falling along the exterior side of the tubular portion 58 from the upper end 60 toward the lower end 62 are guided to the aperture 68 wherein the sand and solids pass into the chamber 66 of the tubular portion 58. The upper end 60 of the diverter section 52 is configured to be connected to a portion of the sucker rod string 14 with a suitable coupling.

In FIG. 3, the collectors 70 of the diverter section 52 are shown to extend from the upper end 60 of the tubular portion 58 toward the lower end 62 of the tubular portion 58 in a spiral configuration. The tubular portion 58 has a plurality of apertures 68 extending therethrough. The channels 72 guide sand and other solids that fall into the channels 72 to the apertures 68 and in turn into the chamber 66 of the tubular portion 58 of the diverter section 52. The collector 70 may be dimensioned to be in contact with the inside surface of the tubing string 12 or nearly in contact so a significant portion of the sand and solids fall into the channel 72.

To permit fluid to pass upwardly past the diverter section 52 during the production of fluids, the diverter section 52 may have a plurality of collectors 70 extending outwardly from the sidewall to cooperate with the exterior side of the tubular portion 58 to form a plurality of channels 72 in which solids traveling along the exterior side of the tubular portion 58 from the upper end 60 toward the lower end 62 are guided to at least one of the apertures 68. The collectors 70 are spaced from one another so vertical slots 74 are formed between adjacent collectors 70. The vertical slots 74 provide a passageway for fluid to travel upwardly past the diverter section 52 when the pump assembly 10 is activated. The vertical slots 74 may be staggered so sand and solids falling downwardly and passing through one of the vertical slots 74 may fall into another channel 70 thereby increasing the amount of sand and solids captured by the sand collector 50.

The upper end 60 of the tubular portion 58 may be provided with one or more openings (FIG. 2) 75 to facilitate the passage of fluid to and from the chamber 66 of the tubular portion 58.

Figure 5:
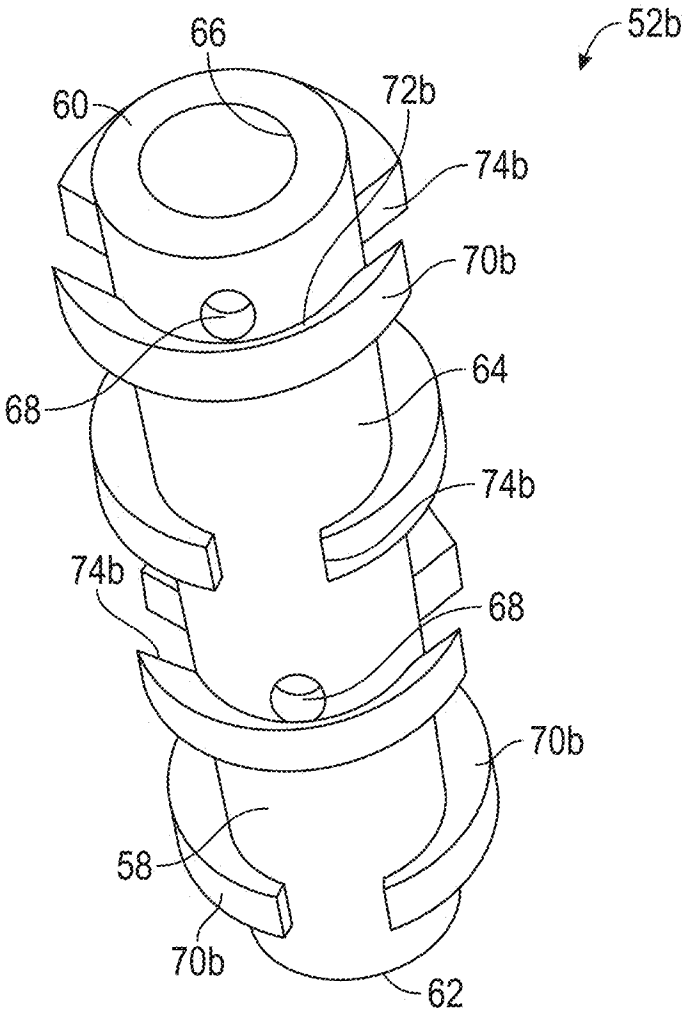
FIG. 5 is a perspective view of another embodiment of a diverter section of the sand collector.
Figure 4:
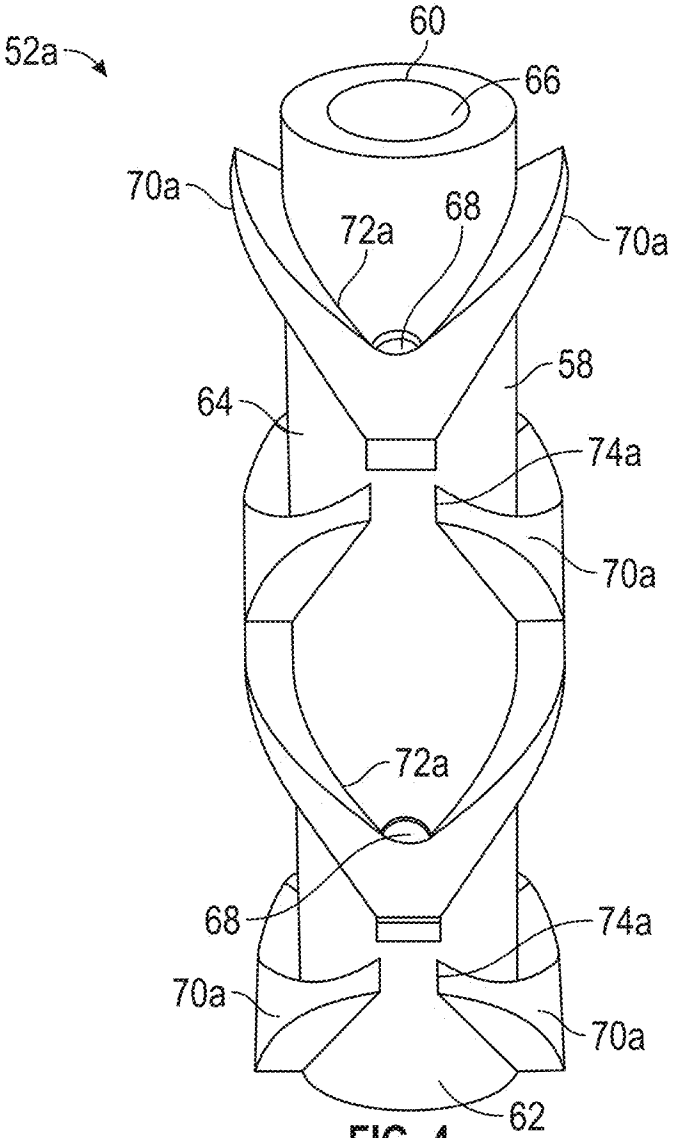
FIG. 4 is a perspective view of another embodiment of a diverter section of the sand collector.

FIGS. 4 and 5 illustrate other embodiments of diverter sections 52*a* and 52*b*. The diverter section 52*a* may have a plurality of collectors 70*a* extending outwardly from the sidewall 64 to cooperate with the exterior side of the tubular portion 58 to form a plurality of V-shaped channels 72*a* in which solids traveling along the exterior side of the tubular portion 58 from the upper end 60 toward the lower end 62 are guided to at least one of the apertures 68. The apertures 68 are formed at a vertex of the V-shaped channels 72*a*.

To permit fluid to pass upwardly past the diverter section 52*a*, the collectors 70*a* are spaced from one another so vertical slots 74*a* are formed between adjacent collectors 70*a*. The collectors 70*a* may be arranged in a plurality of horizontal pairs of collectors 70*a* wherein the collectors 70*a* of each of the horizontal pairs of collectors 70*a* are spaced from one another to form two vertical slots 74*a* between the collectors 70*a*.

The horizontal pairs of collectors 70*a* may be vertically spaced from adjacent horizontal pairs of collectors 70*a* so the vertical slots 74*a* between the collectors 70*a* are vertically aligned with the vertices of the V-shaped channels 72*a* of the adjacent horizontal pairs of collectors 70*a*, thereby staggering the vertical slots 74*a* so sand and solids falling downwardly and passing through one of the vertical slots 74*a* may fall into another channel thereby increasing the amount of sand and solids captured by the sand collector 50.

The diverter section 52*b* may have a plurality of collectors 70*b* extending outwardly from the sidewall 64 to cooperate with the exterior side of the tubular portion 58 to form a plurality of channels 72*b* in which solids traveling along the exterior side of the tubular portion 58 from the upper end 60 toward the lower end 62 are collected and/or guided to at least one of the apertures 68. The collectors 70*b* differ from the collectors 70*a* because the collectors 70*b* have a flatter profile than the collectors 70*a*.

The collectors 70, 70*a*. and 70*b* may be at least partially fabricated of a rubber or plastic material so contact with the interior side of the tubing does not cause excessive wear. The remainder of the diverter section 52 may be fabricated of a suitable metal, such as steel. Alternatively, the collectors 70, 70*a*, and 70 may be formed of a suitable metal, such as steel. In one version, the diverter section 52 may have a length of approximately twelve inches, by way of example.

Figure 6:
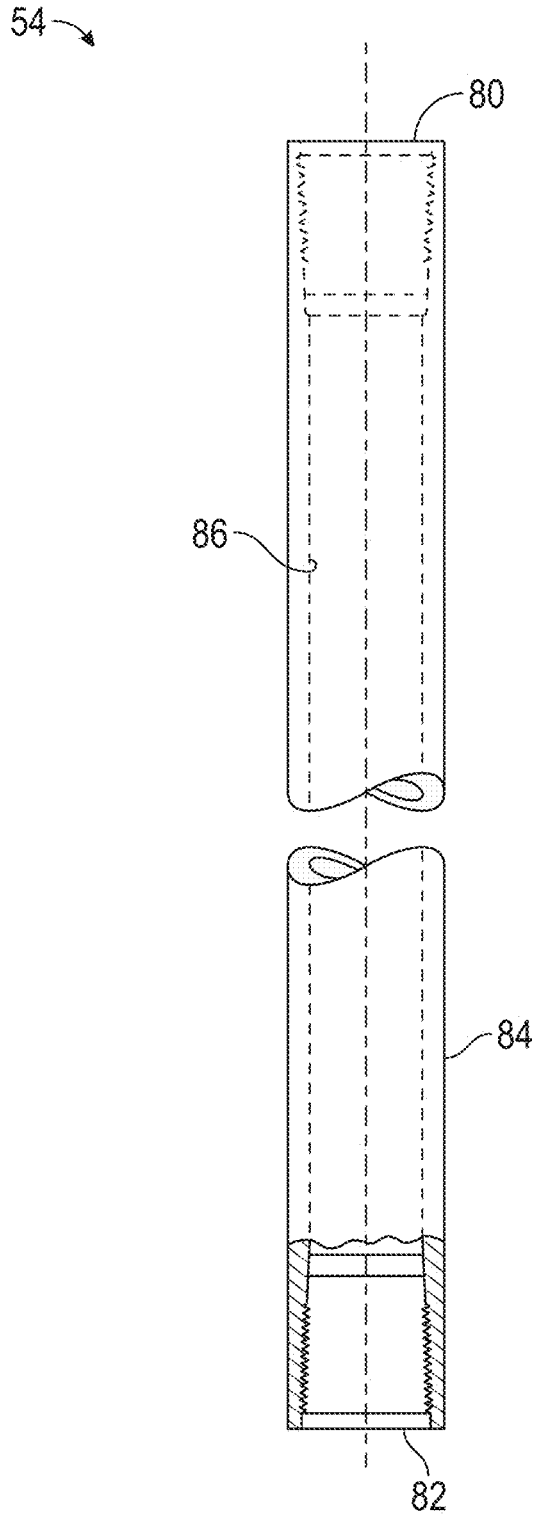
FIG. 6 is a partially cutaway, elevational view of a collector section of the sand collector.
Figure 7:
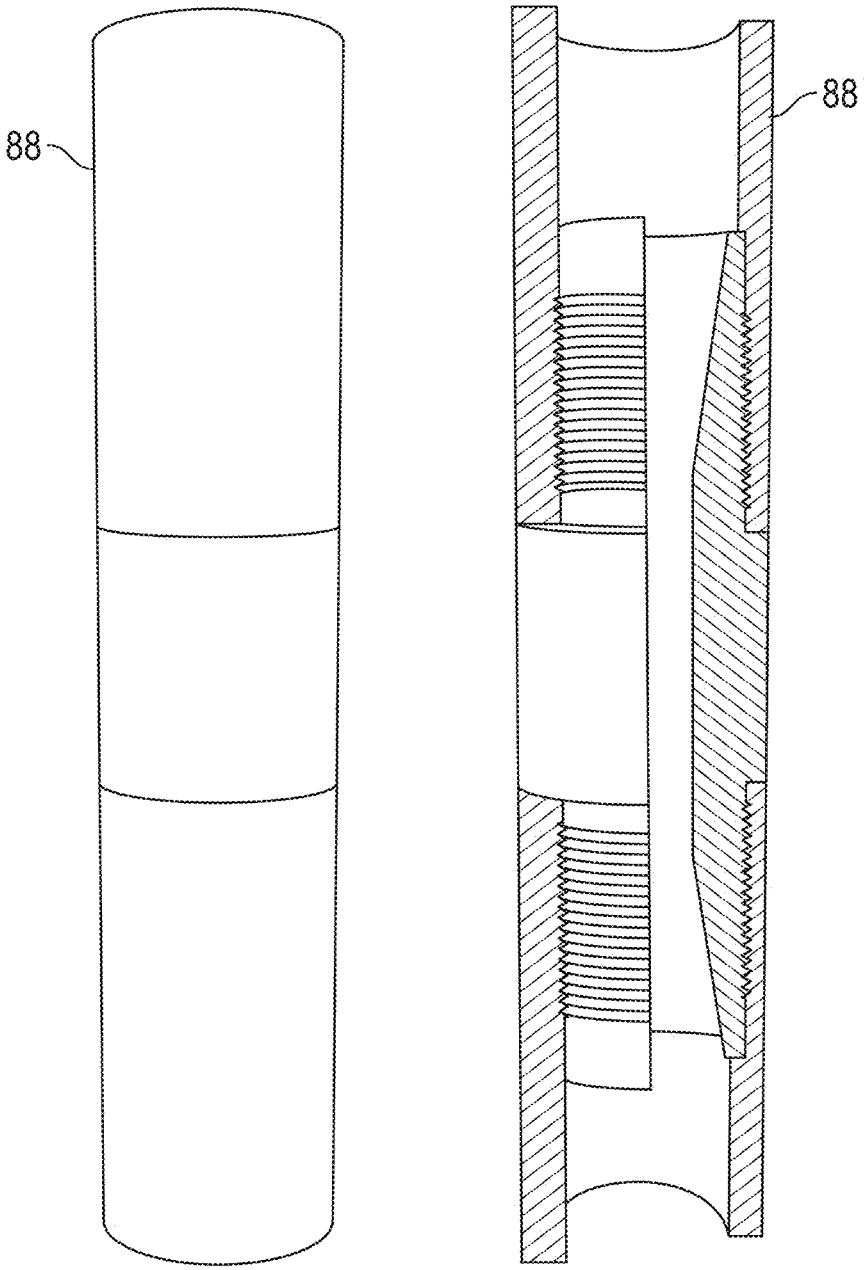
FIG. 7 is an elevational view and sectional view of a coupling.

From the chamber 66 of the tubular portion 58 of the diverter section 52, the sand and solids pass into the collector section 54. As best shown in FIG. 6, the collector section 54 may be a solid tubular member having an upper end 80, a lower end 82, and a sidewall 84 defining a chamber 86 extending between the upper end 80 and the lower end 82. The upper end 80 of the collector section 54 is connected to the lower end 62 of the diverter section 52. In one embodiment, the upper end 80 of the collector section 54 is connected to the lower end 62 of the diverter section 52 with a coupling 88, such as shown in FIG. 7. Alternatively, the collector section 54 and the diverter section 52 may be formed as a unitary tool. In one version, the collector section 54 may have a length of approximately twenty feet. However, it will be appreciated that the length of the collector section 54 may be varied. In one version, the chamber 86 of the collector section 54 may have a diameter of about 0.5 inches to about 2.0 inches, for example. However, like the length, the diameter of the chamber 86 may be varied.

Figure 2:
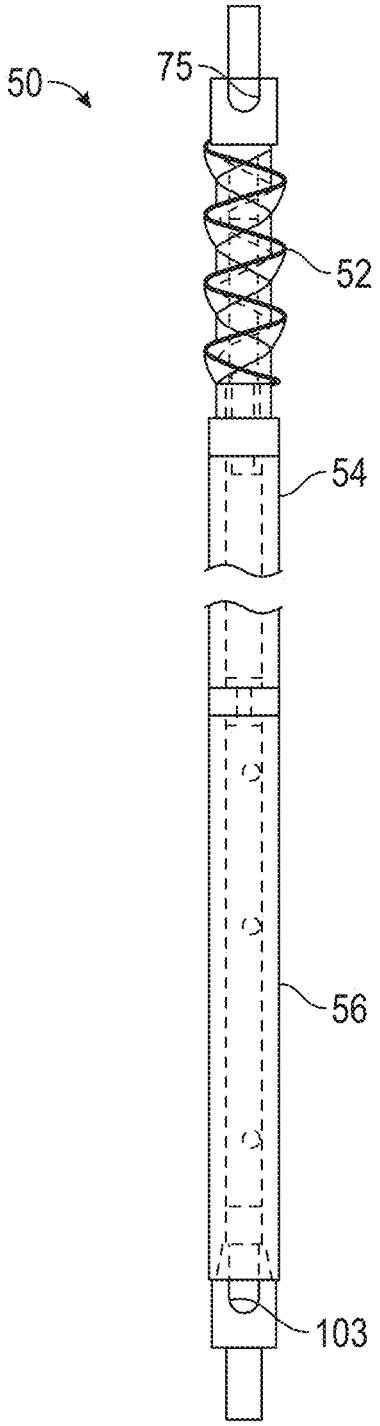
FIG. 2 is an elevational view of the sand collector.
Figure 8:
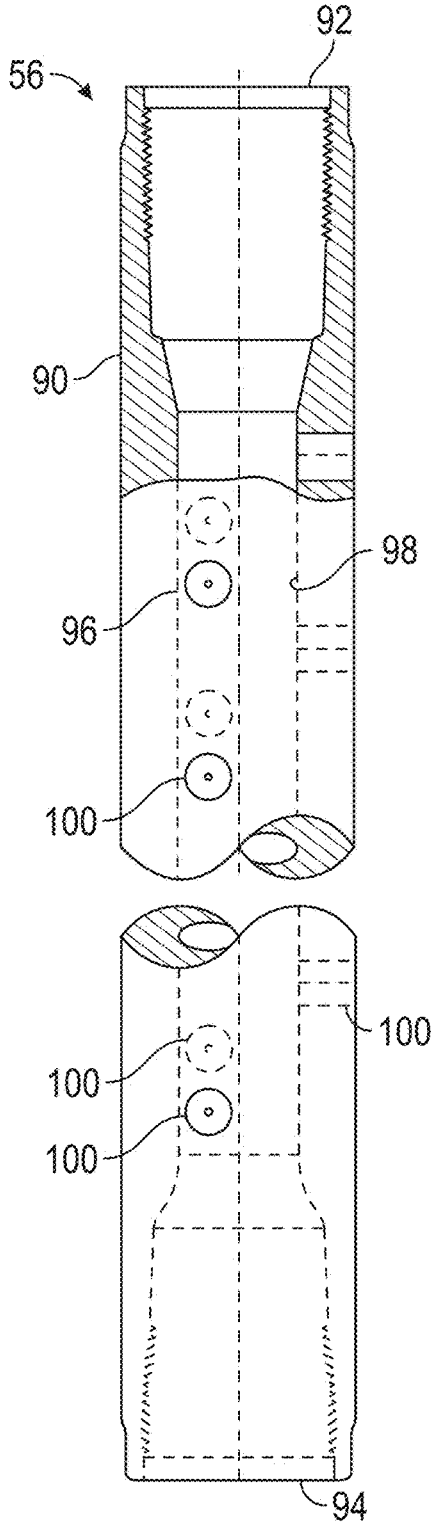
FIG. 8 is a partially cutaway, elevational view of a filter section of the sand collector.
Figure 9:
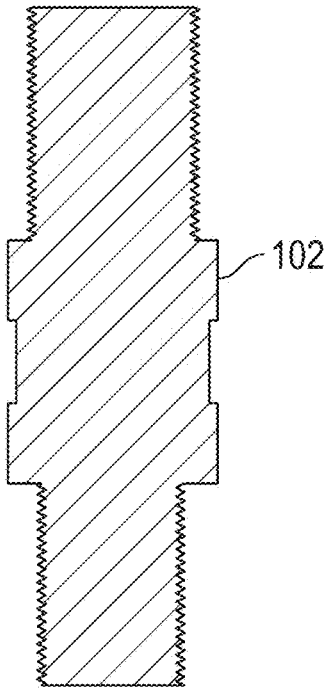
FIG. 9 is a cross-sectional view of a plug.

Referring now to FIG. 8, in one non-limiting embodiment, the filter section 56 includes a tubular portion 90 having an upper end 92, a lower end 94, and a sidewall 96 defining a chamber 98 extending between the upper end 92 and the lower end 94. In one non-limiting embodiment, the filter section 56 has a plurality of apertures 100 extending through the sidewall 96. The upper end 92 of the filter section 56 is connected to the lower end 82 of the collector section 54 and the lower end 94 of the filter section 56 is adapted to be connected to the upper end of the plunger of the pump assembly 10. Alternatively, the collector section 54 and the filter section 56 may be formed as a unitary tool, or the diverter section 52, the collector section 54, and the filter section 56 may be formed as a unitary tool. In one non-limiting embodiment, the lower end 94 of the filter section 56 is closed. The lower end 94 of the filter section 56 may be closed with a plug 102, such as illustrated in FIG. 9. A lower end of the plug 102 is connectable to a portion of the sucker rod string 14 or the upper end of the pump assembly 10. In another embodiment as illustrated in FIG. 2, the lower end 94 of the tubular portion 90 may be provided with one or more openings 103 to facilitate the passage of fluid to and from the chamber 96 of the tubular portion 90.

Figure 10:
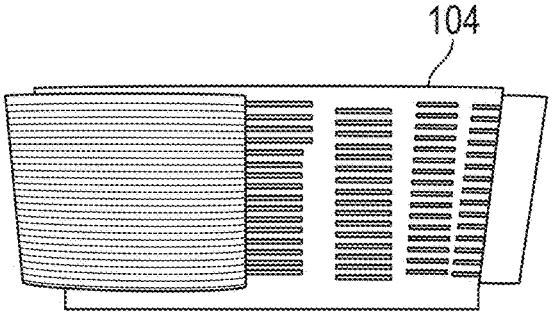
FIG. 10 is an elevational view of a screen.

A screen, such as screen 104 illustrated in FIG. 10, is positioned across the apertures 100 of the filter section 56 on the inside surface of the tubular portion 90 of the filter section 56. The sand and other solids initially collection in the chamber 98 of the filter section 56. The screen 104 is positioned across the apertures 100 of the tubular portion 90 of the filter section 56 and is sized to prevent the sand and solids from passing through the apertures 100 while allowing fluids to pass through the apertures 100 so fluids may pass to and from the filter section 56. In one version, the filter section 56 may have a length of two feet, and the chamber 98 may have a diameter of about 0.5 inches to about 1.5 inches, for example. However, each dimension may be varied. In one version, the apertures 100 may have a diameter in a range of approximately 0.3 inches to about 0.5 inches, for example. In addition, any number of apertures 100 may be formed through the tubular portion 90, and the apertures 100 may be arranged in a variety of ways.

In use, when the pump assembly 10 is activated to cause production fluids to flow upwards through the tubing string 12, fluid flows past the sand collector 50 by passing through the vertical slots 72 or 72*a*. Additionally, fluid can pass through the apertures 100 of the filter section 56, up through the chamber 98 of the filter section 56, up through the chamber 86 of the collector section 54, up through the chamber 66 of the diverter section 52, and exit the apertures 68 of the diverter section 52.

When the pump assembly 10 is deactivated so that fluid is no longer being pumped upwards through tubing string 12, sand or solids in the fluid travel downwardly under the force of gravity. The collectors 70 or 70*a* of the diverter section 52 or 52*a* guide the sand and solids through the apertures 68 of the tubular portion 58 of the diverter section 52. The solids pass through the chamber 66 of the diverter section 52, through the chamber 86 of the collector section 54, and into the chamber 98 of the filter section 56 where the screen 104 and the closed lower end 94 cause the sand and solids to be contained in the filter section 56. As the sand and solids continue to accumulate, the sands and solids accumulate in the chamber 86 of the collector section 54.

When the pump assembly 10 is reactivated, production fluid is caused to flow upwards through the tubing string 12. This upward flow of fluid causes a portion of the fluid to pass into the filter section 56 via the apertures 100 to lift the sand and solids accumulated in the filter section 56 and the collector section 54. The sands and solids are entrained in the flow upwards through the sand collector 50 and out of the apertures 68 of the diverter section 52 and into the tubing string 12. Therefore, the accumulated sands and solids are purged from the sand collector 50 during the production phase.

The sand collector 50 may be positioned in any desired location within the sucker rod string 14. Additionally, more than one of the sand collectors 50 may be employed in the sucker rod string 14.

Figure 15A:
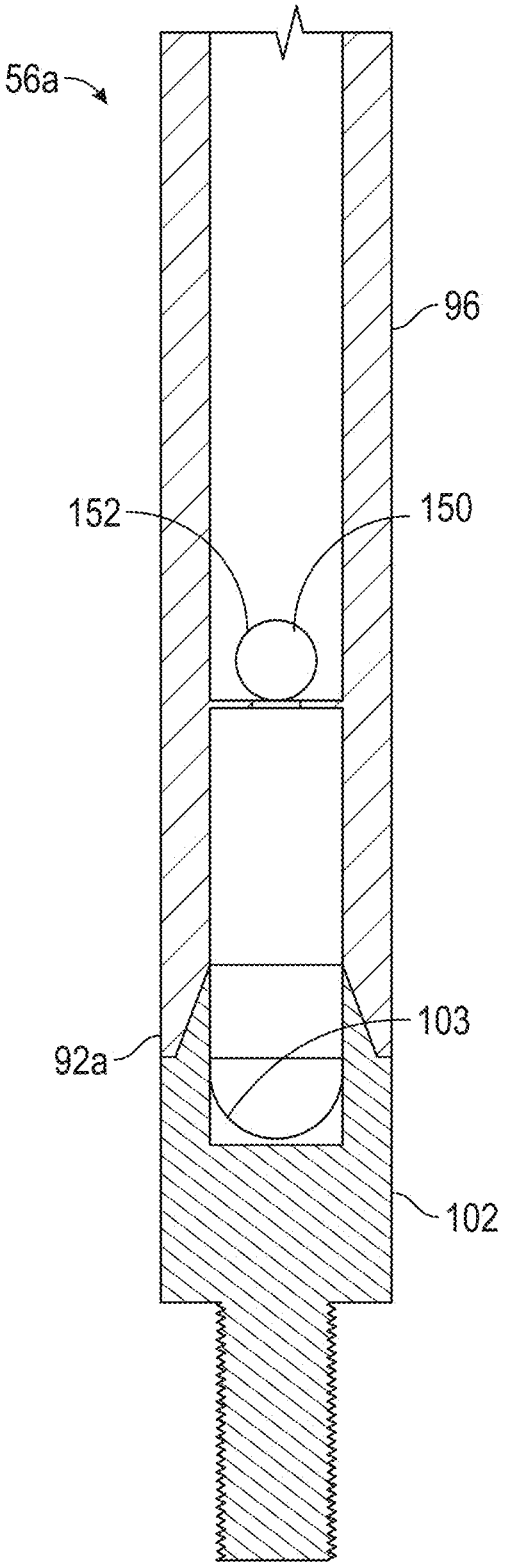
FIG. 15A is a sectional view of a lower portion of another embodiment of a porous section.
Figure 15B:
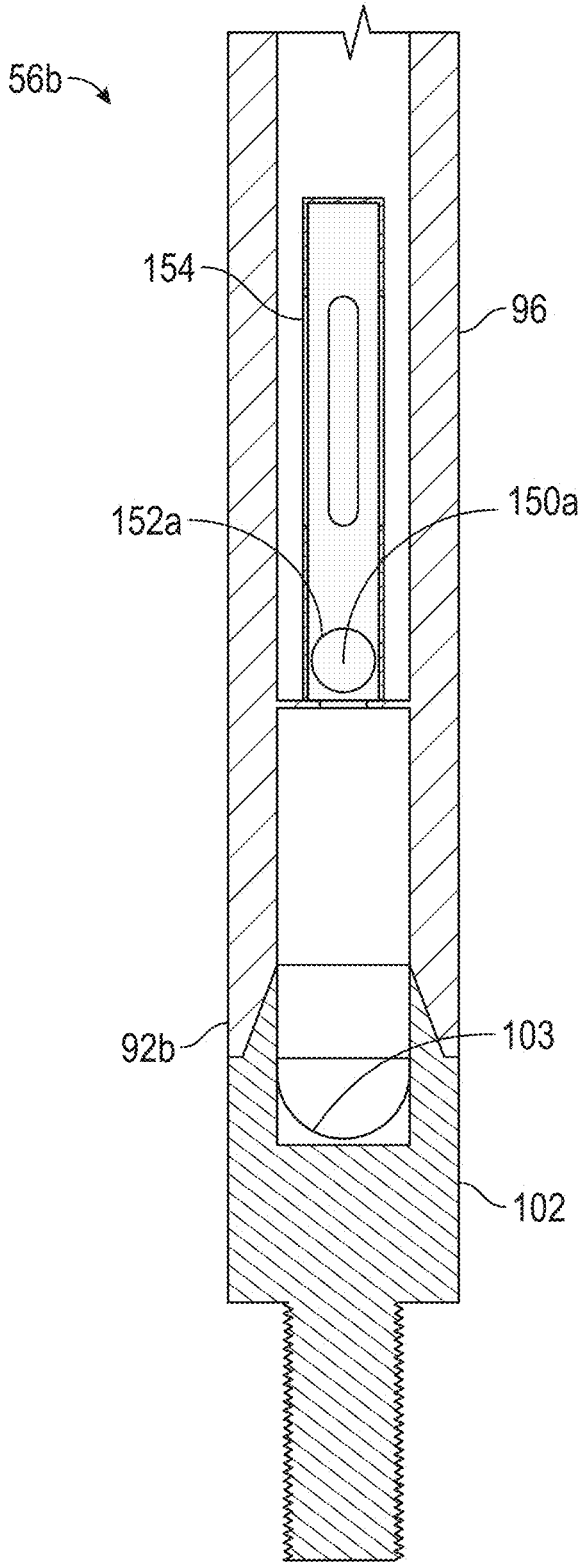
FIG. 15B is a sectional view of a lower portion of another embodiment of a porous section.
Figure 15C:
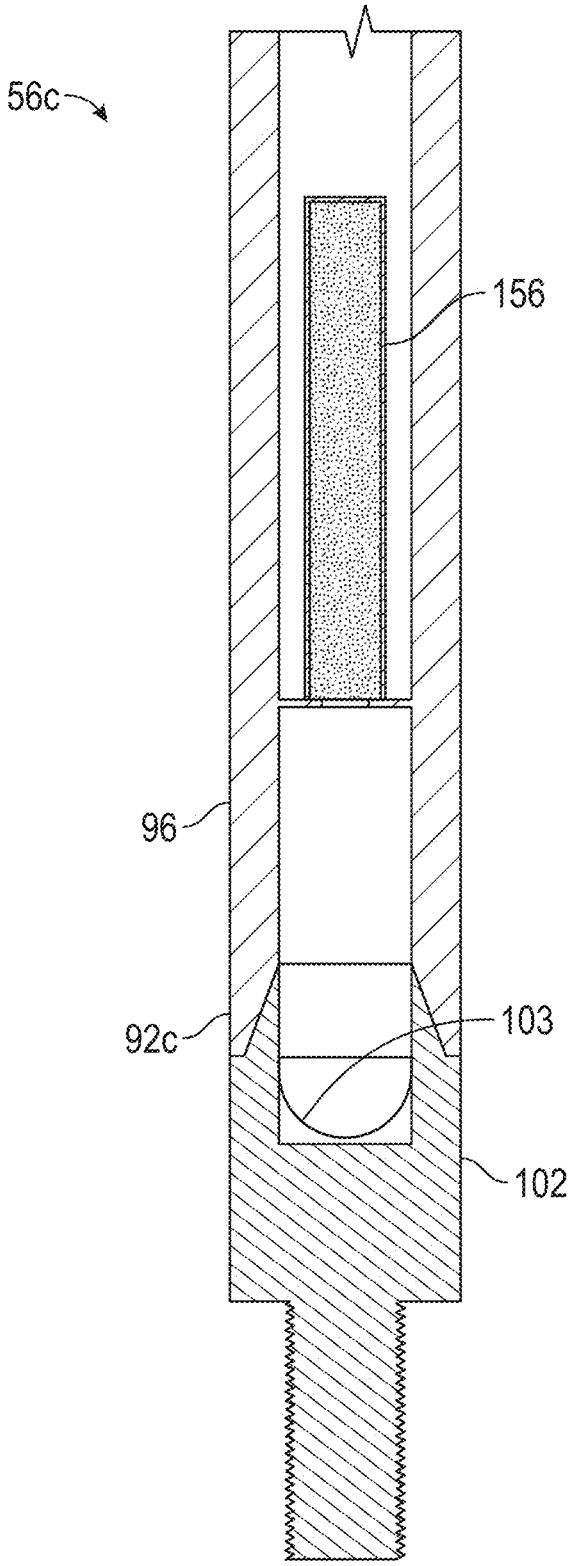
FIG. 15C is a sectional view of a lower portion of another embodiment of a porous section.

Referring now to FIGS. 15A-15C, other embodiments of filter sections are illustrated. FIG. 15A illustrates a lower portion of a filter section 56*a*. The filter section 56*a* is similar to the filter section 56, except as described below. The filter section 56*a* has a lower end 92*a* that includes a check valve 150. In the embodiment illustrated in FIG. 15A, the sidewall 96 does not include the apertures 100, but in some embodiments the filter section 56*a* could include the apertures 100, the screen 104, and the check valve 150.

The check valve 150 includes a one-way valve member 152, such as a ball. When the pump assembly 10 is activated, the check valve 150 moves to an open position to permit the flow of fluid up through the filter section 56*a*. When the pump assembly 10 is deactivated, the check valve 150 moves to a closed position and sand and other solids collect in the chamber 98 of the filter section 56*a*.

FIG. 15B illustrates a lower portion of a filter section 56*b*. The filter section 56*b* is similar to the filter section 56*a*, except as described below. The filter section 56*b* has a lower end 92*b* that includes a check valve 150*a*. In the embodiment illustrated in FIG. 15B, the sidewall 96 does not include the apertures 100, but in some embodiments the filter section 56*b* could include the apertures 100, the screen 104, and the check valve 150*a*.

The check valve 150*a* includes a one-way valve member 152*a*, such as a ball. The filter section 56*b* further includes a cage 154 positioned around the check valve 150*a* to guide the valve member 152*a*. As with the filter section 56*a*, when the pump assembly 10 is activated, the check valve 150*a* moves to an open position to permit the flow of fluid up through the filter section 56*b*. When the pump assembly 10 is deactivated, the check valve 150*a* moves to a closed position and sand and other solids collect against the screen 154 and in the chamber 98 of the filter section 56*a*.

FIG. 15C illustrates a lower portion of a filter section 56*c*. The filter section 56*c* has a lower end 92*c* that includes a screen 156. In the embodiment illustrated in FIG. 15C, the sidewall 96 does not include the apertures 100, but in some embodiments the filter section 56*c* could include the apertures 100, the screen 104, and screen 156.

As with the filter section 56*b*, when the pump assembly 10 is activated, the screen 156 permit the flow of fluid up through the filter section 56*b*. When the pump assembly 10 is deactivated, and other solids collect against the screen 156 and in the chamber 98 of the filter section 56*a*.

Figure 11:
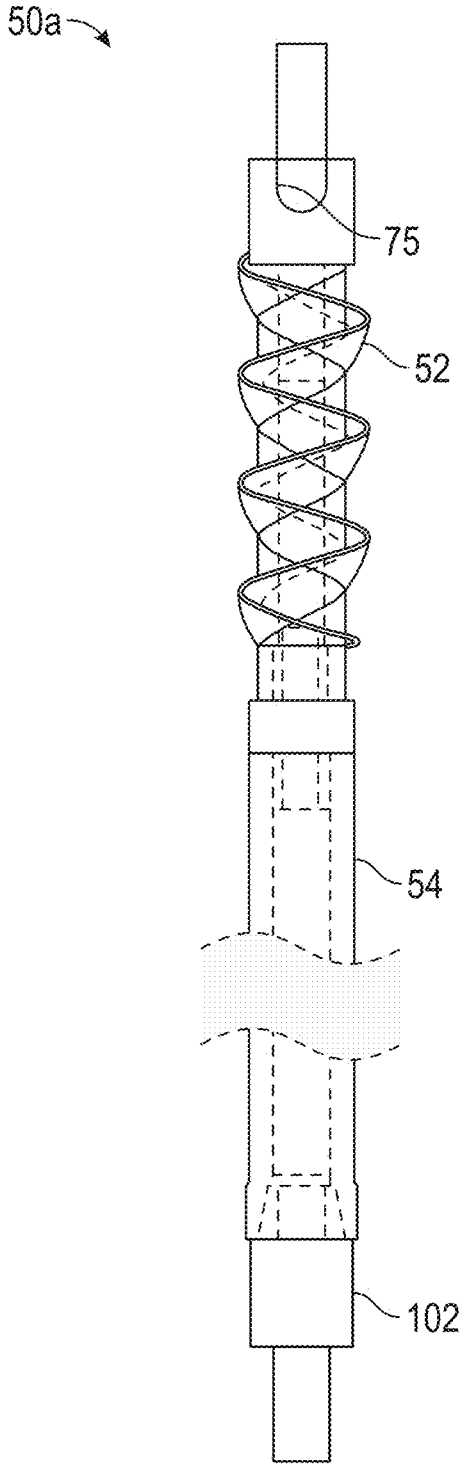
FIG. 11 is an elevational view of another embodiment of a sand collector constructed in accordance with the inventive concepts disclosed herein.

FIG. 11 illustrates another embodiment of a sand collector 50*a*. The sand collector 50*a* is similar to the sand collector 50 described above, except the sand collector 50*a* includes no filter section 56. The sand collector 50*a* includes a diverter section 52 and a collector section 54. The lower end of the collector section 54 is closed with the plug 102, which is connectable to a portion of the sucker rod string or the upper end of the pump assembly 10.

The sand collector 50*a* operates similarly to the sand collector 50, except when the pump assembly 10 is reactivated, the upward flow of fluid flow past the apertures 68 and 75 of the diverter section 52 causes the sand and other solids accumulated in the collector section 54 to be drawn out through the apertures 68 and 75 and into the tubing string 12.

Figure 12:
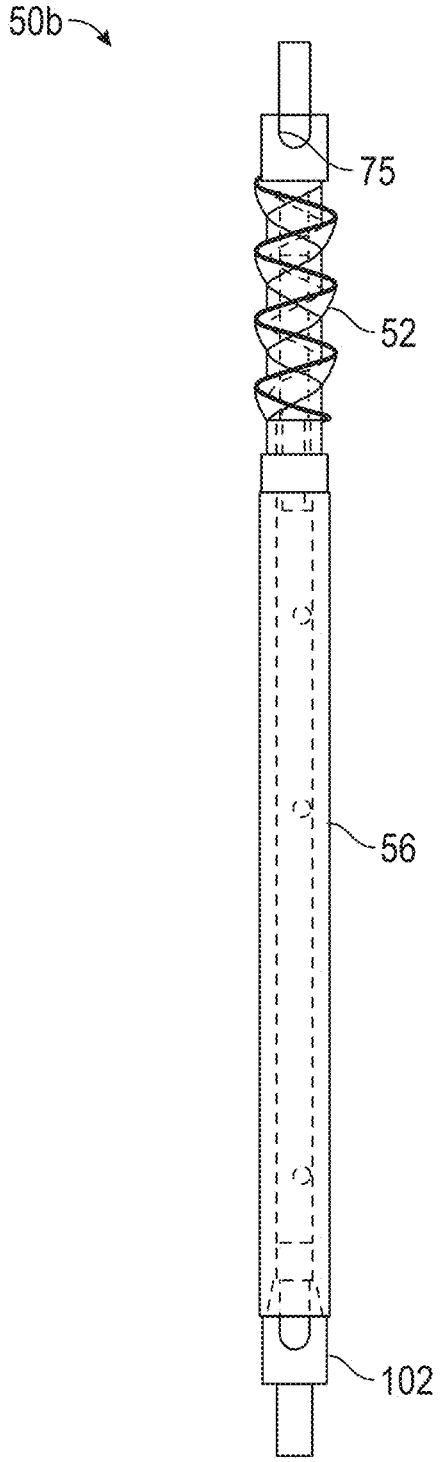
FIG. 12 is an elevational view of another embodiment of a sand collector constructed in accordance with the inventive concepts disclosed herein.

FIG. 12 illustrates another embodiment of a sand collector 50*b*. The sand collector 50*b* is similar to the sand collectors 50 and 50*a* described above, except the sand collector 50*b* includes no collector section 54. The sand collector 50*b* includes a diverter section 52 and a filter section 56. The upper end 82 of the filter section 56 extends from the lower end 62 of the diverter section 52. Similar to the sand collector 50, the lower end of the filter section 54 is closed with the plug 102, which is connectable to a portion of the sucker rod string 14 or the upper end of the pump assembly 10.

The sand collector 50*b* operates similarly to the sand collector 50.

FIGS. 13A-13C and 14 illustrate another embodiment of a sand collector 100 constructed in accordance with the inventive concepts disclosed herein. The sand collector 100 is shown incorporated into a tubing string 12*a* and a sucker rod string 14*a* so the sand collector 100 is positioned above the plunger 24 to collect sand and other solids falling toward the pump assembly 10 and thereby reduce the amount of sand and solids entering the pump assembly 10 when the pump assembly 10 is shut down.

The sand collector 100 includes a diverter section 102 and a collection section 104.

Figure 14:
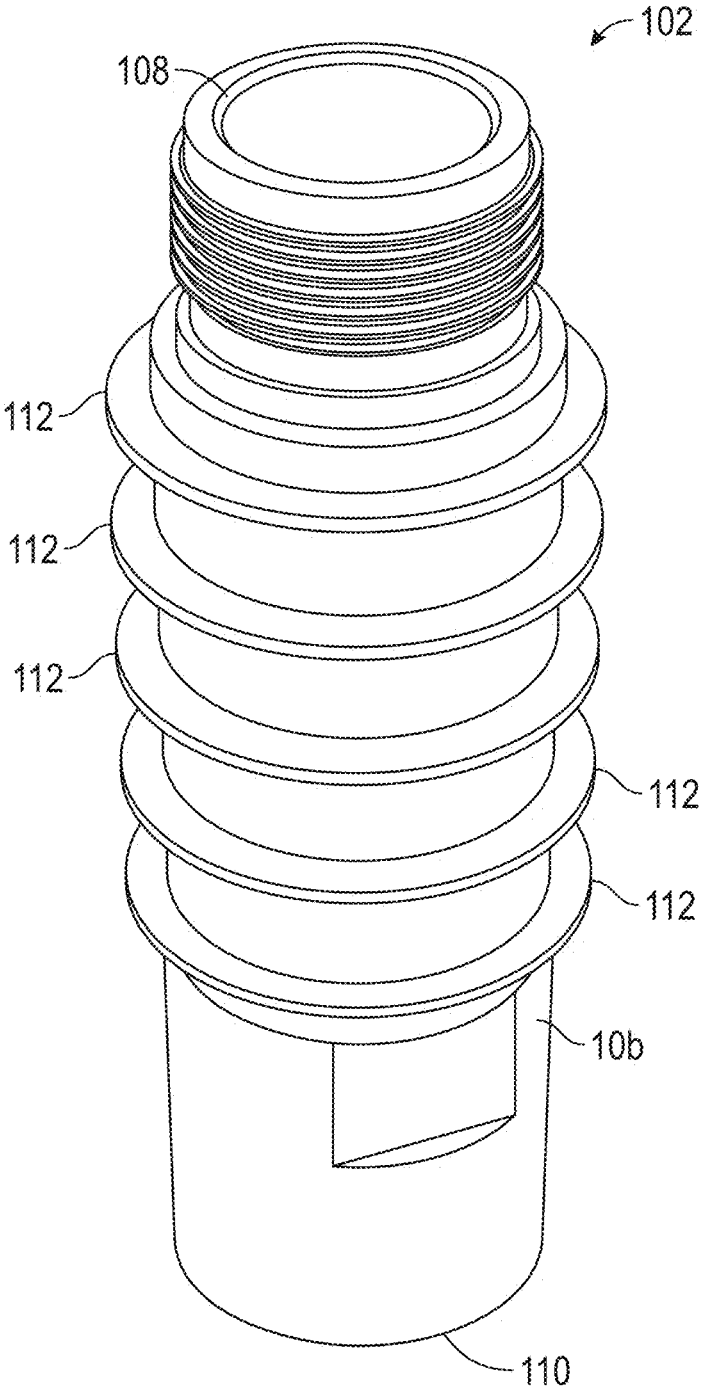
FIG. 14 is a perspective view of another embodiment of a diverter section.

As best shown in FIG. 14, the diverter section 102 may include a cylindrical body portion 106 with an upper end 108 and a lower end 110. The diverter section 102 further includes at least one collector 112 extending outwardly from the sidewall to cooperate with an exterior side of the body portion 106 to direct sand and solids falling downwardly away from the body portion 106. The upper end 108 and the lower end 110 of the body portion 106 are configured to be connected to a portion of the sucker rod string 14*a* with a suitable coupling.

The collectors 112 of the diverter section 102 are shown to be at least one annular member extending from the upper end 108 of the body portion 106. In one embodiment, a plurality of collectors 112 is provided with the collectors 112 being vertically spaced. In one version, the collectors 112 are sufficiently flexible to permit fluid to flow upwardly past the collectors 112, yet sufficiently rigid enough to direct sand and other solids away from the body portion. The collectors 112 may be formed of a suitable rubber. In another version, the collectors 112 have slots or slits (not shown) formed therein to facilitate the passage of fluid during operation of the pump assembly. The slots or slits may be staggered relative to the slots or slits of an adjacent one of the collectors 112 for collecting sand and solids. The collectors 112 may be dimensioned to be in contact with the inside surface of the tubing string 12*a* or nearly in contact so a significant portion of the sand and solids are diverted.

The collector section 104 comprises a body 120 formed from a top sub assembly 122, a pressure retaining housing 124, and a bottom sub assembly 126. The body 120 defines a through bore 128 between an upper end 130 and a lower end 132. The lower end 132 is coupled to the tubing string 14*a* above the pump assembly 10. The collector section 104 may be located immediately above the pump assembly 10 or in another desired position.

The collector section 104 also comprises an inner tubular 140, which extends along a part of the body 120. The inner tubular 140 is concentric with the body 120 so as to provide a continuation of a main bore of the tubing string 12*a*. In one embodiment, the inner tubular 140 has an inner diameter approximately equal to the main bore of the tubing string 12*a*. The inner tubular 140 divides the through bore into a first flow region 142 on the inside of the inner tubular 140 and a second flow region 144 in an annular space between the inner wall of the housing 124 and the inner tubular 140. The inner tubular 140 includes one or more apertures such that the first flow region 142 and the second flow region 144 are in fluid communication. The inner tubular 140 is also provided with a screen 146 to prevent the passage of solids having a size larger than the apertures in the screen 146 from passing between the first and second flow regions.

At the upper end of the inner tubular 140 is an opening 148 through which the diverter section 102 diverts the flow of fluid and solids in a manner described below.

Figure 13A:
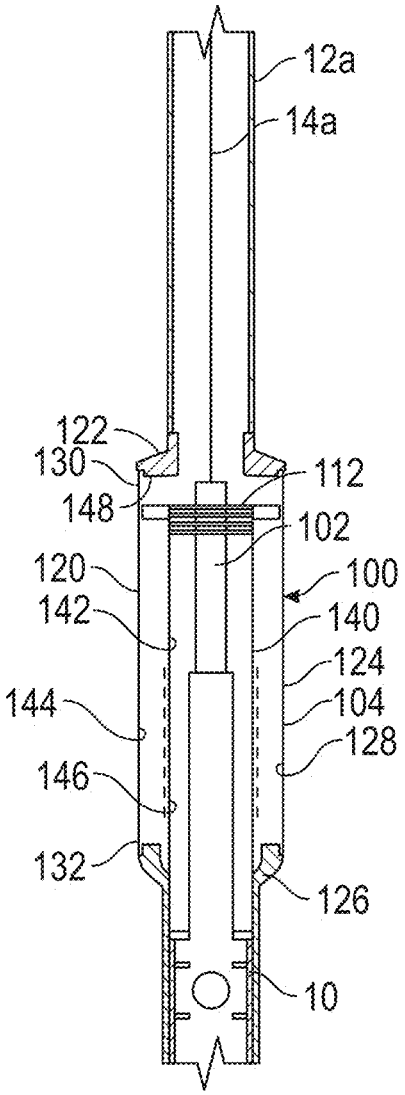
FIGS. 13A-13C are sectional views of another embodiment of a sand collector showing different phases of operation.

FIG. 13A illustrates the sand collector 100 in a production phase with the sucker rod string 14*a* and the pump assembly 10 in an up position to cause production fluids to flow upwards through the tubing string 12*a*, entering the lower opening and exiting the upper end and/or flowing past the collectors 112. As fluid flows into the sand collector 100, it enters the first flow region 142. The fluids also enter the second flow region 144 through apertures in the inner tubular 140 such that fluid also flows upwards in the annular space between the housing 124 and the inner tubular 140. The upward pressure created by the pump assembly 10 acts against the collectors 112 and may cause the fluid to flow past the collectors 112.

Figure 13B:
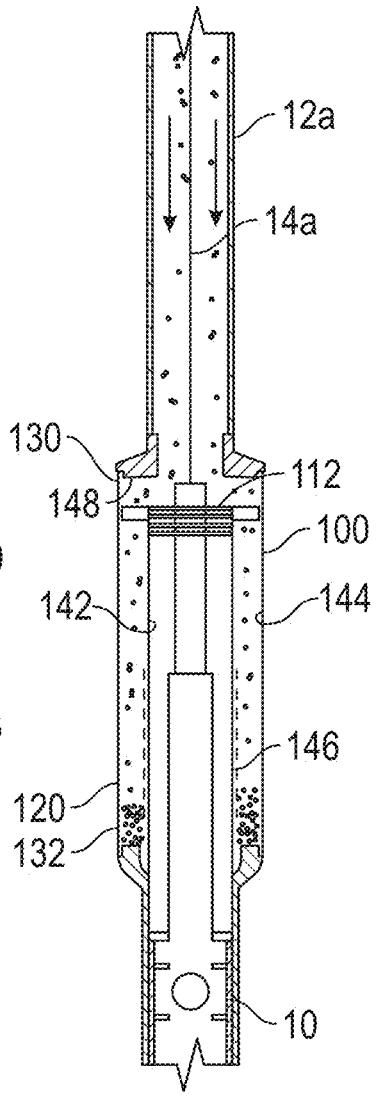

FIG. 13B shows the pump assembly 10 deactivated so fluid is no longer pumped upwards. The pump assembly 10 is deactivated in an up position so the collectors 112 are positioned adjacent the opening 148. This prevents a majority of fluid, together with sand and solids from entering the first flow region 142 from an upper part of the sand collector 100. Fluid flows downwards in the apparatus 100 and is diverted to the second flow region 144. Sand and solids entrained in the fluid are also diverted into the second flow region 144. The fluid may pass into the first flow region 142 through the apertures in the inner tubular 140, and out through the lower end. The screen 146 functions to contain the sand and other solids in the second flow region 144.

Figure 13C:
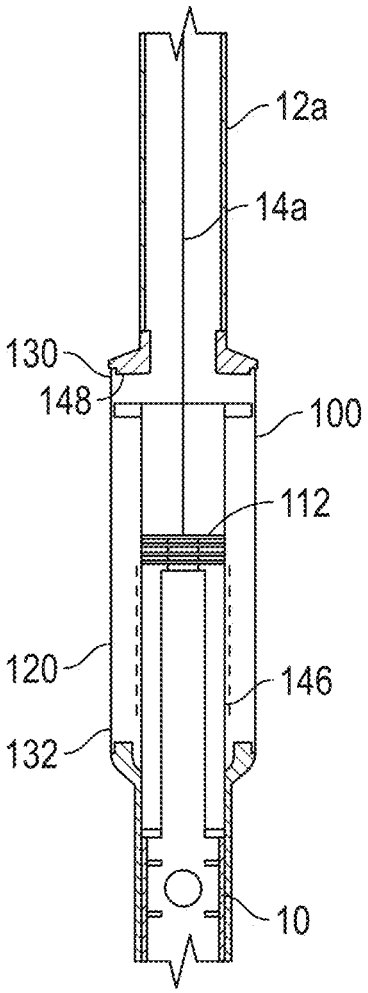

FIG. 13C shows a subsequent production phase, after operation of the pump assembly 10 has been resumed. Production fluid is caused to flow upwards through the sand collector 100. As fluid flows upwardly in the first flow region 142, fluid also flows into the second flow region 144. This induces fluid flow in the second region 144 which lifts and carries sands and solids, which have accumulated in the second flow region 144 during the shutdown phase. The sands and solids are entrained in the flow upwards through the sand collector 100 and out of the upper end, into the tubing string 12*a*.

Although the presently disclosed inventive concepts have been described in conjunction with the specific language set forth herein above, many alternatives, modifications, and variations will be apparent to those skilled in the art. Accordingly, it is intended to embrace all such alternatives, modifications, and variations that fall within the spirit and broad scope of the presently disclosed inventive concepts. Changes may be made in the construction and the operation of the various components, elements, and assemblies described herein, without departing from the spirit and scope of the presently disclosed inventive concepts.

What is claimed is:

1. A sand collector for a pump assembly, comprising:

a diverter section having a cylindrical body portion with an upper end, a lower end, and at least one collector diverter, the upper end and the lower end being connectable to a portion of a sucker rod string for reciprocating movement of the pump assembly and the diverter section; and a collector section including a body and an inner tubular, the body having an upper end and a lower end and defining a through bore between the upper end and the lower end, collector section being connectable to a portion of a tubing string and the lower end being connectable to another portion of the tubing string, the inner tubular extending along the body and being concentric with the body to provide a continuation of a main bore of the tubing string, the inner tubular dividing the through bore into a first flow region on the inside of the inner tubular and a second flow region in an annular space between an inner wall of the body and the inner tubular, the inner tubular having an opening at an upper end thereof and the inner tubular having at least one aperture at a lower end thereof such that the first flow region and the second flow region are in fluid communication, wherein the collector of the diverter section diverts the flow of fluid and solids from the first flow region to the second flow region through at least one of the openings in at least one position of the diverter section relative to the collector section.

2. The sucker rod assembly of claim 1, wherein the inner tubular has a screen to prevent the passage of solids having a size larger than the aperture from passing between the first flow region and the second flow region.

3. The sucker rod assembly of claim 1, wherein the collector of the diverter section extends from the body portion.

4. The sucker rod assembly of claim 3, wherein the collector is a plurality of collectors spaced from one another.

5. The sucker rod assembly of claim 4, wherein the collectors are sufficiently rigid to direct sand and other solids away from the body portion.

6. A sucker rod pump assembly, comprising:

a tubing string positioned in a well bore to define a main bore;

a sucker rod string positioned in the tubing string for reciprocating movement therein, the sucker rod string including a plurality of sucker rods;

a pump assembly having at least a reciprocating portion connected to the lower end of the sucker rod string for reciprocating movement; and a sand collector comprising:

a diverter section incorporated as a portion of the sucker rod string, the diverter section having a cylindrical body portion with an upper end, a lower end, and at least one collector; and a collector section incorporated as a portion of the tubing string, the collector section including a body and an inner tubular, the body having an upper end and a lower end and defining a through bore between the upper end and the lower end, the inner tubular extending along the body and being concentric with the body to provide a continuation of the main bore of the tubing string, the inner tubular dividing the through bore into a first flow region on the inside of the inner tubular and a second flow region in an annular space between an inner wall of the body and the inner tubular, the inner tubular having an opening at an upper end thereof and the inner tubular having at least one aperture at a lower end thereof such that the first flow region and the second flow region are in fluid communication, wherein the collector of the diverter section diverts the flow of fluid and solids from the first flow region to the second flow region through at least one of the openings in at least one position of the diverter section relative to the collector section.

7. The sucker rod assembly of claim 6, wherein the inner tubular has a screen to prevent the passage of solids having a size larger than the aperture from passing between the first flow region and the second flow region.

8. The sucker rod assembly of claim 6, wherein the collector of the diverter section extends from the body portion.

9. The sucker rod assembly of claim 8, wherein the collector is a plurality of collectors spaced from one another.

10. The sucker rod assembly of claim 9, wherein the collectors are sufficiently rigid to direct sand and other solids away from the body portion.

11. The sucker rod pump assembly of claim 6, wherein the pump assembly comprises:

a pump barrel having an upper end, a lower end, and a chamber extending through the pump barrel from the upper end to the lower end;

a standing valve in the pump barrel to permit a one-way flow of fluid into the chamber of the pump barrel;

a plunger disposed in the chamber of the pump barrel above the standing valve and connected to the sucker rod string for reciprocating movement through at least a portion of the chamber of the pump barrel; and a traveling valve in the plunger to permit one way flow of fluid into the plunger.

* * * * *